US011707165B2

(12) United States Patent
Zaky

(10) Patent No.: US 11,707,165 B2
(45) Date of Patent: Jul. 25, 2023

(54) PORTABLE PERSONAL PRIVACY TOILET

(71) Applicant: Mahmood Zaky, Totowa, NJ (US)

(72) Inventor: Mahmood Zaky, Totowa, NJ (US)

(73) Assignee: Mahmood Zaky, Totowa, NJ (US)

( * ) Notice: Subject to any disclaimer, the term of this patent is extended or adjusted under 35 U.S.C. 154(b) by 0 days.

(21) Appl. No.: 17/408,388

(22) Filed: Aug. 21, 2021

(65) Prior Publication Data

US 2023/0054814 A1 Feb. 23, 2023

(51) Int. Cl.
*A47K 11/02* (2006.01)

(52) U.S. Cl.
CPC ..... *A47K 11/02* (2013.01)

(58) Field of Classification Search
CPC ..... A47K 11/02; E04H 15/46; E04H 15/48
See application file for complete search history.

(56) References Cited

U.S. PATENT DOCUMENTS

| | | | | |
|---|---|---|---|---|
| 5,586,344 | A * | 12/1996 | Liang | A47K 11/02 4/476 |
| 6,378,142 | B1 | 4/2002 | Gray | |
| 6,681,413 | B2 | 1/2004 | Weiss | |
| 7,185,375 | B1 | 3/2007 | Movsas | |
| 7,200,878 | B2 | 4/2007 | Payne | |
| 8,079,096 | B2 | 12/2011 | Roberts | |
| 10,808,414 | B2 | 10/2020 | McClendon | |
| 2003/0121093 | A1 | 7/2003 | Braxton | |
| 2007/0245477 | A1 | 10/2007 | Land | |
| 2008/0034489 | A1* | 2/2008 | Chen | A47K 11/02 4/483 |
| 2009/0038066 | A1 | 2/2009 | Kallmann et al. | |
| 2012/0000015 | A1 | 1/2012 | McClendon et al. | |
| 2014/0109310 | A1 | 4/2014 | Meressa | |
| 2015/0272407 | A1 | 10/2015 | Weir | |
| 2019/0142231 | A1 | 5/2019 | Nelson | |

FOREIGN PATENT DOCUMENTS

| | | | |
|---|---|---|---|
| CA | 2816750 | A1 | 11/2014 |
| CN | 201185899 | Y | 1/2009 |
| CN | 201759467 | U | 3/2011 |
| CN | 102493681 | A | 6/2012 |
| CN | 102828552 | A | 12/2012 |
| CN | 203597857 | U | 12/2013 |
| CN | 103705167 | A | 4/2014 |
| CN | 103932629 | A | 7/2014 |
| CN | 105011848 | A | 11/2015 |
| CN | 105380557 | A | 12/2015 |
| CN | 105559682 | A | 5/2016 |
| CN | 206220571 | U | 6/2017 |
| CN | 208551617 | U | 3/2019 |
| CN | 111734204 | A | 10/2020 |
| JP | 3108936 | U | 3/2005 |

* cited by examiner

*Primary Examiner* — Janie M Loeppke
(74) *Attorney, Agent, or Firm* — Locke Lord LLP; Gabrielle L. Gelozin

(57) ABSTRACT

An apparatus includes a frame, where the frame includes a plurality of telescoping vertical supports, a plurality of telescoping horizontal supports hingedly connected to a respective vertical support of the plurality of vertical supports, and a telescoping main cross bar hingedly connected to and extending between at least two of the vertical supports situated in a diameter depression in the at least two of the vertical supports. A seat is hingedly connected to the main cross bar, and an outer shell is operatively connected to a respective portion of the frame defining a plurality of walls.

20 Claims, 7 Drawing Sheets

PORTABLE PERSONAL PRIVACY TOILET

BACKGROUND

1. Field

The present disclosure relates to portable structures, and more particularly to portable personal toilet facilities.

2. Description of Related Art

There are many situations in which a toilet or other privacy device may be needed, but public toilet facilities are not readily available, for example while camping, at a beach or park, a roadside, or the like. In certain situations, it may not be possible to find a suitable place to use the restroom or otherwise create a private shelter for this purpose. Conventional portable toilet systems are large and require substantial effort to erect and therefore may not be suitable for quick set-up and breakdown, packing, and/or transport.

The conventional techniques have been considered satisfactory for their intended purpose. However, there is an ever present need for improved systems and methods for portable toilet and privacy structures. This disclosure provides a solution for this need.

SUMMARY

In accordance with at least one aspect of this disclosure, an apparatus includes a frame, where the frame includes a plurality of telescoping vertical supports, a plurality of telescoping horizontal supports hingedly connected to a respective vertical support of the plurality of vertical supports, and a telescoping main cross bar hingedly connected to and extending between at least two of the vertical supports situated in a diameter depression in the at least two of the vertical supports. A seat is hingedly connected to the main cross bar, and an outer shell is operatively connected to a respective portion of the frame defining a plurality of walls.

In embodiments, the outer shell defines a front wall, a back wall opposite the front wall, a first side wall, a second side wall opposite the first side wall, and a top wall. In embodiments, the outer shell can be opaque and can be comprised of at least one of burlap, mesh, and/or canvas. The front wall is hingedly connected to a single vertical support on a first end, and includes a fastener on a second end opposite the first end. In certain embodiments, the fastener is configured to mate with a respective fastener on the second side wall in a closed position.

In embodiments, the first side wall and second side wall are each hingedly connected to a first and second respective vertical support of the plurality of vertical supports. A top wall is hingedly connected to a respective horizontal support a first end. In embodiments, the top wall further includes a fastener on a second end opposite the first end, where the fastener is configured to mate with a respective fastener on the front wall in a closed position. The mating of the fasteners will retain the top wall and the front wall in respective closed positions. In embodiments, the front wall, back wall, first side wall, and second side wall are positioned such that the apparatus occupies a rectangular footprint in an erected state.

In certain embodiments, an extension arm is hingedly connected to and extending horizontally from a respective one of the vertical supports. The extension arm can further include a stopper on a free end of the extension arm, opposite the hinged connection. In certain such embodiments, the respective one of the vertical supports has a first diameter and a second diameter, the first diameter being larger than the second diameter, where the extension arm is hingedly connected to the respective one of the vertical supports on the second diameter to allow rotational movement of the extension arm about the respective one of the vertical supports and to prevent vertical movement of the extension arm along the respective one of the vertical supports.

In embodiments, the seat further includes an upper rim and a lower rim separate from the upper rim. Both the upper and lower rim are hingedly connected to the main cross bar and can be configured to clamp a waste collection device therebetween. In embodiments, the seat further comprises at least one weight bearing member hingedly connected to an underside of the lower rim, configured to support a user seated on the seat. In embodiments, the main cross bar can further includes at least one stopper proximate the seat configured to limit an amount of collapse of the main cross bar.

In certain embodiments, each of the plurality of vertical supports include a lower anchor portion configured to anchor the apparatus when erected. In certain embodiments, the lower anchor portions can extend beyond an lower edge of an outer perimeter of a respective front, side, or back wall.

In embodiments, each horizontal support can be configured to collapse along a horizontal axis and each vertical support can be configured to collapse along a longitudinal axis such that the apparatus is configured to fold in the collapsed state. At least one wall can further include a fastener and at least one opposed wall includes a respective mating fastener configured to retain the apparatus in the collapsed state. In certain embodiments, a handle portion can be disposed on a respective horizontal support. In certain embodiments, at least one wheel can be disposed on at least one of a respective vertical supports, opposite the handle portion. In certain embodiments, the wheels are hingedly connected to the respective vertical supports.

In accordance with another aspect of this disclosure, there is provided a personal, mobile, toilet kit. In embodiments, the kit can include a toilet seat hingedly connected to a frame having a plurality of horizontal and vertical supports, an outer shell operatively connected to the frame, and a container configured to retain the personal, mobile, toilet in a collapsed state.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
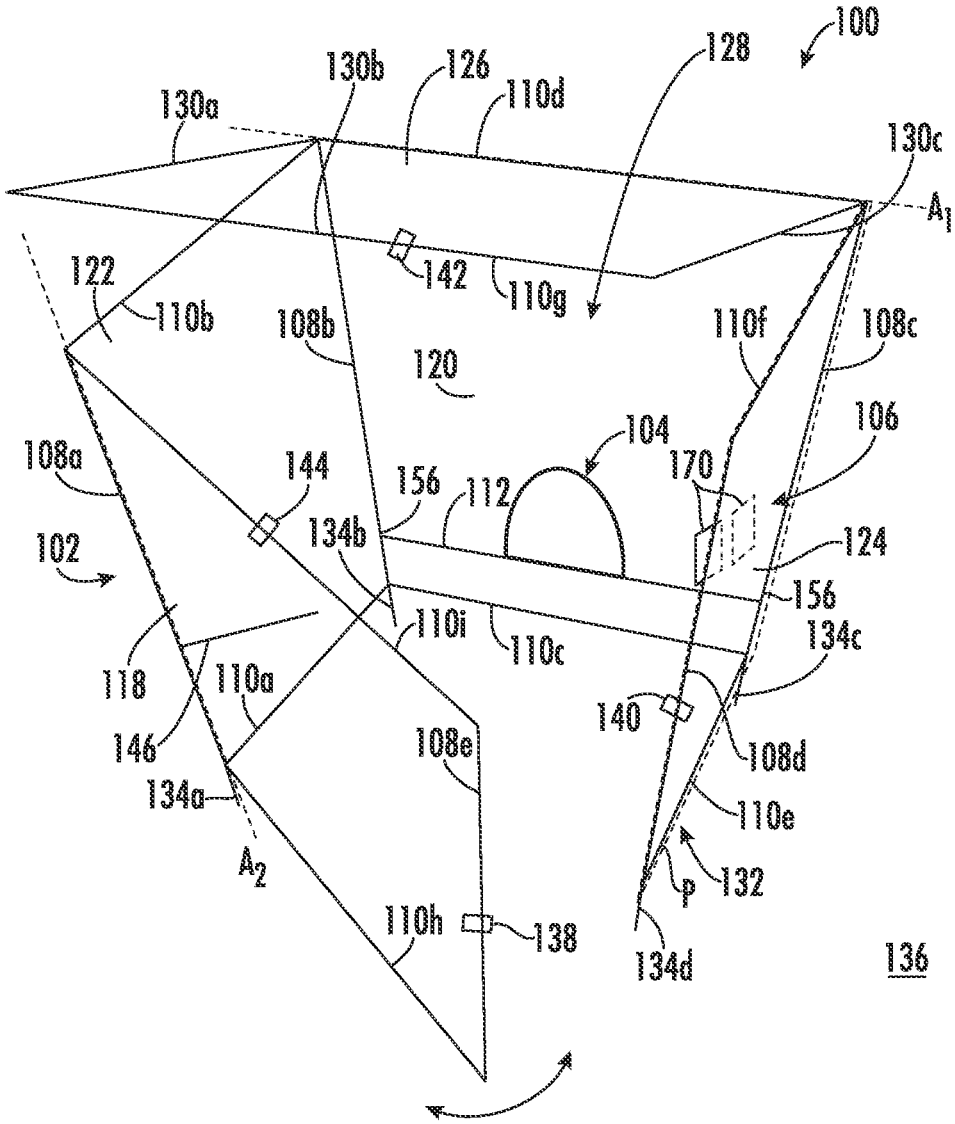
FIG. 1 is a schematic perspective view of an embodiment of a toilet structure constructed in accordance with the present disclosure, showing the erected toilet structure, where the top wall and front wall are in a partial open position.

Reference will now be made to the drawings wherein like reference numerals identify similar structural features or aspects of the subject disclosure. For purposes of explanation and illustration, and not limitation, a partial view of an embodiment of a structure in accordance with the disclosure is shown in FIG. 1 and is designated generally by reference character 100. Other embodiments of systems in accordance with the disclosure, or aspects thereof, are provided in FIGS. 2-8, as will be described.

Described herein is a personal, portable toilet structure 100, designed to be compact, lightweight, while still providing the necessary functionality and privacy of bathroom facilities. The toilet structure 100 is comprised of a frame 102, a toilet seat 104, and an outer shell 106. The frame 102 includes a plurality of telescoping vertical supports 108*a-e*, a plurality of telescoping horizontal supports 110*a-i* hingedly connected to a respective vertical support of the plurality of vertical supports 108*a-e*, and a telescoping main cross bar 112 hingedly connected to and extending between vertical supports 108*b* and 108*c*. The telescoping action of the vertical and horizontal supports 108, 110 can be accomplished in any suitable manner, for example ball lock pins, button clips, threated rotation, quick releases, flip levers, clamps, or the like. The vertical and horizontal supports 108, 110 can be connected such that the erected toilet occupies a generally rectangular footprint (e.g. including a square footprint), for example as shown in FIG. 1.

Figure 2:
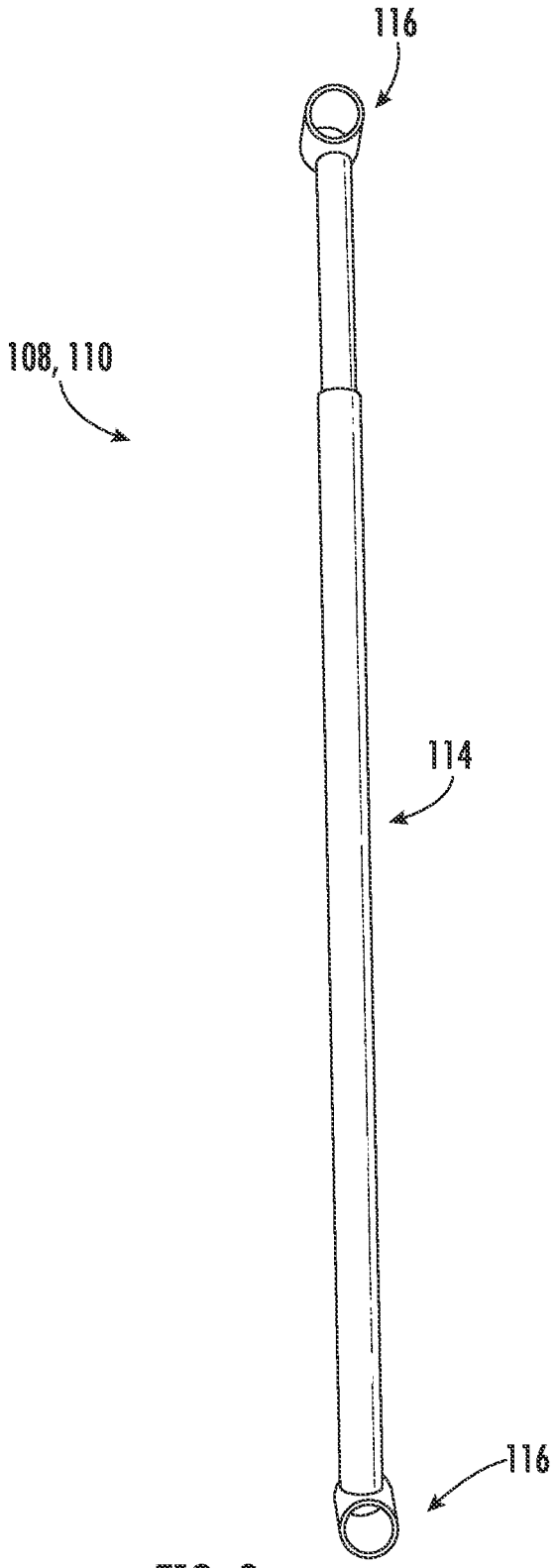
FIG. 2 is an enlarged schematic view of a vertical or horizontal support of the structure of FIG. 1, showing the structure of the support.

The horizontal and vertical supports 108, 110 can be comprised of a straight portion 114 and at least one integral hinge portion 116, where the hinge portion 116 can be a ring or collar shaped hinge configured to engage the straight portion 114 of the respective support 108, 110 to which it connects, as shown in FIG. 2. For example, the plurality of vertical and horizontal supports 108, 110 can be connected such that the frame creates a plurality of walls, e.g. a front wall 118, a back wall 120 opposite the front wall 118, a first side wall 122, a second side wall 124 opposite the first side wall 122, and a top wall 126, enclosing an interior 128.

For example, the front wall 118 can include a first vertical support 108*a*, a second vertical support 108*e*, an upper horizontal support 110*i* and a lower horizontal support 110*h*. Similarly the back wall 120 includes a first vertical support 108*b*, a second vertical support 108*c*, an upper horizontal support 110*d*, and a lower horizontal support 110*c*. The first side wall 122 can include an upper horizontal support 110*b* and a lower horizontal support 110*a*, each hingedly connected to the first vertical support 108*a* of the front wall 118 and the first vertical support 108*b* of the back wall 120. The second side wall 124 can include an upper and lower horizontal support 110*f*, 110*e* and a first vertical support 108*d*, and can be connected in a similar manner to the first side wall 122, however it should be appreciated that because the front wall 118 is configured to serve as a door (e.g. as described further below) where the second vertical support 108*e* of the front wall 118 is not shared between the front wall 118 and the second side wall 124. Instead, the second sidewall 124 includes a separate vertical support 108*d* to which its horizontal supports 110*e*, 110*f* attach. The top wall 126 includes a first support 130*a*, a second support 130*b*, and a third support 130*c*, where the first and second supports 130*a*, 130*b* are hingedly connected to the upper horizontal support 110*d* of the back wall 120.

Each wall of the frame 106 can define an outer perimeter P (shown only with respect to second side wall 124 for clarity), and the vertical supports 110 for each wall can extend beyond the lower edge 132 of the outer perimeter P, serving as a lower anchor portion 134*a-d*, for example to anchor the portable toilet 100 into the ground 136 on which it sits. However, it should be noted that the second vertical support 108*e* of the front wall 118 should not extend beyond the lower edge of the outer perimeter so that the front wall 118 is free to swing between an open and closed position. In embodiments, the lower anchor portions 134*a-d* can have any suitable shape needed to be driven into the ground with little effort, for example the lower anchor portions can be spike or stake shaped, or have a generally tapered end.

As described above, the front wall 118 can be configured as a door. In embodiments, the front wall 118 can include an internal fastener 138 on or proximate to the second vertical support 108*e* configured to made with a respective fastener 140 on the second side wall 124 in the closed position, so that the door (front wall 118) will remain closed while the toilet 100 is in use. The fastener 140 should be accessible from the interior 128 so as to operate as a locking device. In certain embodiments, the fastener 140 is only accessible from the interior 128. Similarly, in certain embodiments, the top wall 126 can also have a fastener 142 positioned on or proximate to the third support 130*b* configured to mate with a respective fastener 144 on the front wall 118 in the closed position. The mating of the top wall fastener 144 will not only retain the top wall 126 in a closed position, but will also add additional security in retaining the front wall 118 in the closed position. As used herein, fastener includes any suitable fastening means, including but not limited to, hook and loop fastener, buttons, snaps, latches, pins, magnets, or the like. It is also contemplated however, that the fastener need not be a fastener pair, for example a single fastener can be configured to mate directly with a respective vertical 108 or horizontal 110 support, such as a c-clip.

Figure 3:
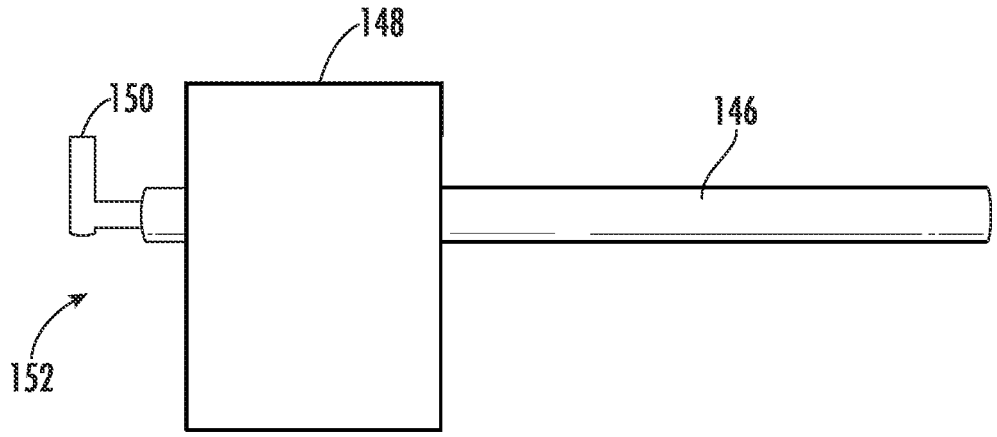
FIG. 3 is an enlarged schematic view of an extension arm, showing a sanitary item held on the extension arm.

Turning to FIG. 3, in certain embodiments, an extension arm 146 is hingedly connected to, and extending horizontally from, the first vertical support 108*a* of the front wall 118, configured to hold sanitary items 148 while the toilet 100 is in use, for example, to hold a toilet paper roll. The extension arm 146, can freely swing about vertical support 108*a* so that the extension arm 146 can lay flush against first side wall 122, or against the front wall 118 as needed, or can be placed at any suitable angle therebetween. The extension arm 146 can further include a stopper 150 on a free end 152 of the extension arm 146, opposite the hinged connection to prevent the sanitary items 148 from falling off of the extension arm 146. The stopper can include any suitable stopper, such as an L-shaped (e.g. as shown), a plug, a ring type, or the like. The stopper should be able to be inserted or attached, and removed as needed to place items on, or remove the sanitary items 148 from the extension arm 146 before and/or after use. In certain embodiments, the extension arm 146 itself can have a curved end 152 to prevent the roll 148 from falling off the extension arm 146. In certain such embodiment, eliminating a stopper 150 can be advantageous, for example to reduce a total number of parts to assemble.

Figure 4:
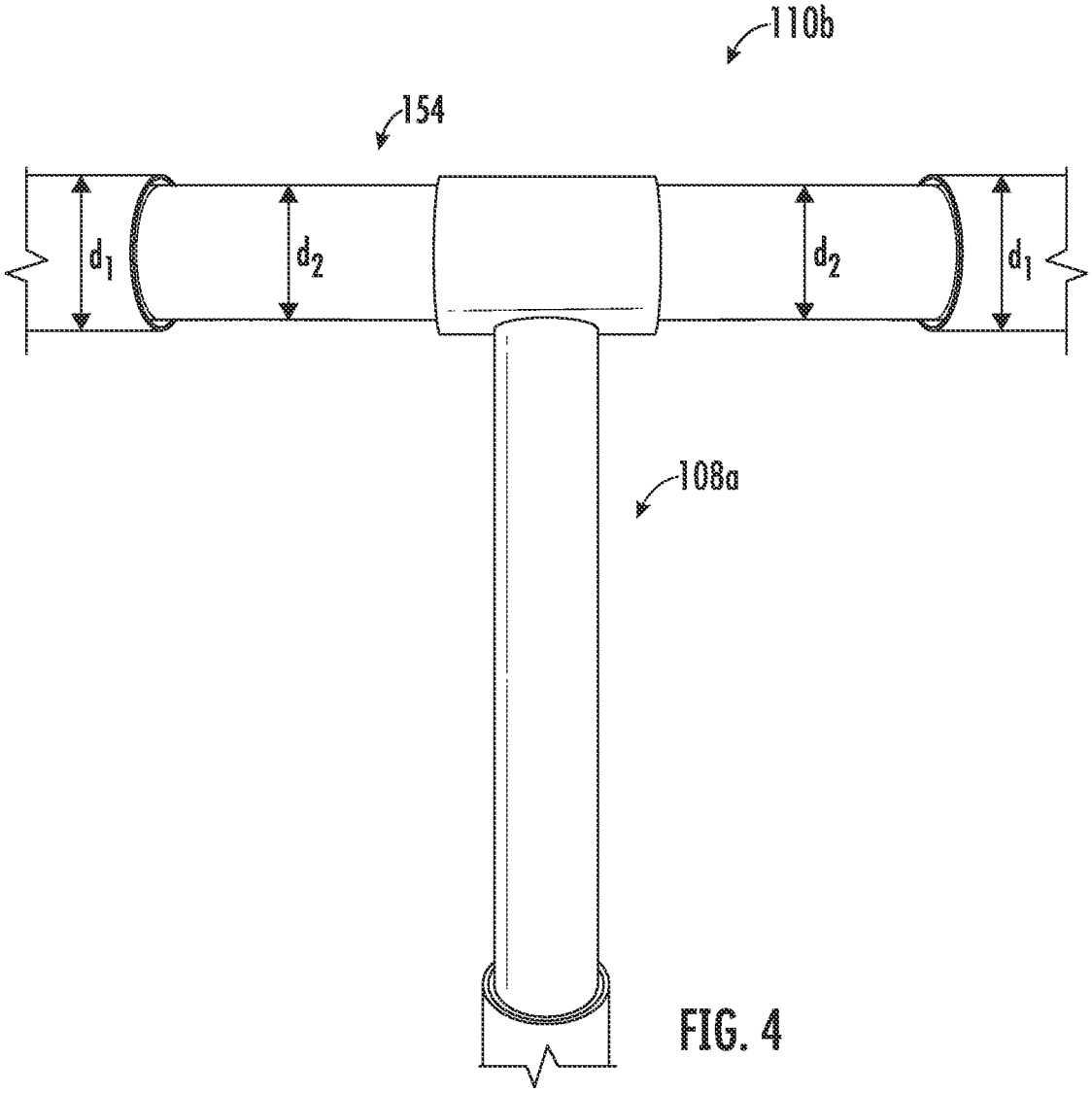
FIG. 4 is an enlarged schematic view of two supports of FIG. 1 showing the hinged connected between the two within a diameter depression.

As shown in FIG. 4, the first vertical support 108*a* of the front wall 118 can have first diameter d1 and a portion 154 (e.g. a diameter depression) having a second diameter d2, the first diameter d1 being larger than the second diameter d2. The upper horizontal support 110*b* is thus connected to the first vertical support 108*a* of the front wall 118 at the portion 154 having the second diameter d2 so that the first vertical support 108*a* cannot move horizontally along upper horizontal support 110*b*, but the first vertical support 108*a* is still allowed to rotate freely about the upper horizontal support 110*b*. It should be understood that FIG. 4 is enlarged for clarity, for example to show the nature of the connection between the horizontal and vertical supports 108, 110. The axial length of portion 154, while shown to extend well beyond the hinge 116 of first vertical support 108*a*, the portion 154 may in actuality abut the hinge on either side. In certain instances it may be beneficial to have some horizontal movement along the upper horizontal support 110*b* (e.g. less than 1 mm in total axial translation), or it may be advantageous to have no movement at all. Moreover, although FIG. 4 shows the connection between upper horizontal support 110*b* and first vertical support 108*a*, it should be understood that the same or a similar connection, and portion 154 can be included with respect to the remaining horizontal and vertical supports 108, 110. Any other suitable connections is contemplated herein, for example stoppers (e.g. o-rings) bounding the hinge to prevent axial movement of the hinge.

Figure 5:
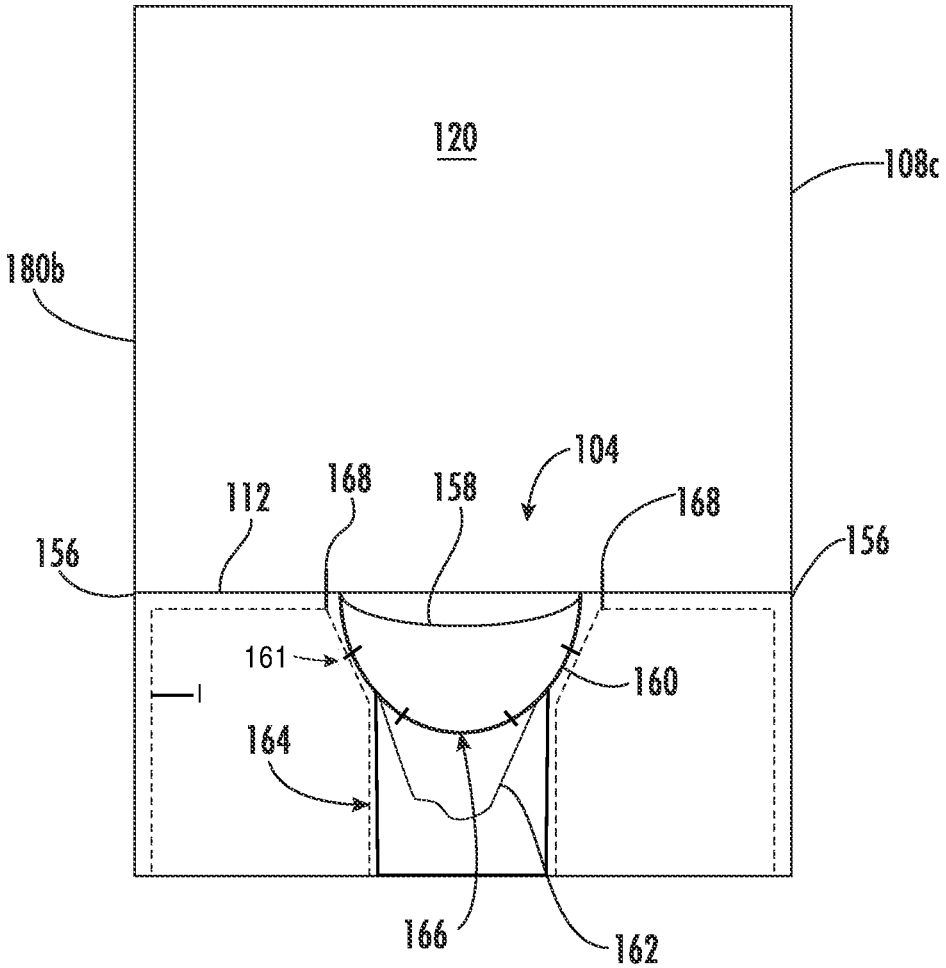
FIG. 5 is a schematic perspective view of an interior of the back wall of the structure of FIG. 1.

Turning to FIG. 5, the main cross 112 bar extends horizontally along the back wall 120, connecting between the first and second vertical supports 108*b*, 108*c* of the back wall 120. Similar to the extension arm 146, the hinged connections of the main cross bar 112 are situated in a diameter depression 156 (e.g. a portion having diameter d2 similar to that shown in FIG. 4) in each of the first and second vertical supports 108*b*, 108*c* of the back wall 120 so that the main cross bar 112 can rotate about the vertical supports 108*b*, 108*c*, but cannot move vertically along the vertical supports 108*b*, 108*c*.

The seat 104 includes an upper rim 158 and a lower rim 160 hingedly connected to the main crossbar 112, where the rims 158, 160 are separate from one another so they may hinge independently. The upper and lower rims 158, 160 are thus configured to clamp a waste collection device 162 therebetween, for example a waste bag, a waste container, or the like. In certain embodiments, at least one of the upper and/or lower rim 158, 160 can include protrusions 161 (e.g. one or more) configured to hold the collection device 162 in place and prevent slippage from between the rims 158, 160. While four protrusions 161 are shown, any suitable number of protrusions 161 can be included as needed or desired to provide additional security.

At least one weight bearing member 164 is hingedly connected to an underside 166 of the lower rim 162, configured to support a user seated on the seat 104. For example, when preparing to use the toilet 100, the upper and lower rims 158, 160 can be hinged to a position parallel to the ground 136, and the at least one weight bearing member 164 can be hinged to a positon perpendicular to both the seat 104 and the ground 136. The at least one weight bearing member 164 can have any suitable design, such as a plurality of vertical stakes, a u-shaped member, or the like. In embodiments, an end portion of the weight bearing member 164 can have a flat foot so that the weight bearing member 164 does not sink into the surface upon which it is mounted (e.g. unstable ground, loose soil or sand, or the like). When in use, a load path/of the weight of the user should thus be dispersed through the at least one weight bearing member 146, the main cross bar 112, and the first and second vertical supports 108*b*, 108*c* of the back wall 120.

In certain embodiments, the main cross bar 112 can also include at least one stopper 168 proximate the seat 104 configured to limit the distance of collapse of the main cross bar 112. The stopper 168 can be any suitable stopper, for an example an o-ring type stopper separate from the main cross bar 112, or in certain embodiments, the stopper 168 could be configured such as shown in FIG. 4, where the main cross bar 112 includes a recess having a diameter d2 for each hinge of the seat 104. In this manner, although the main cross bar 112 is collapsible, the position of the stopper(s) 168 will dictate the final horizontal size of the collapsed toilet 100.

In embodiments, the outer shell 106 is operatively connected to each individual of the walls 118, 120, 122, 124, 126 of the frame 102 to create a privacy screen. For example, the outer shell 106 can be of an opaque, water resistant, and/or water proof material, to protect the user from the weather and the eyes of passersby. The material of the outer shell 106 can be any suitable material for this purpose, such as burlap and/or canvas, as desired, but any other material that offers sufficient privacy can be used. On the interior 128 of the outer shell, a plurality of pockets 170 may be included for storage of personal items while the toilet 100 is in use (e.g. as shown in FIG. 1).

Figure 6:
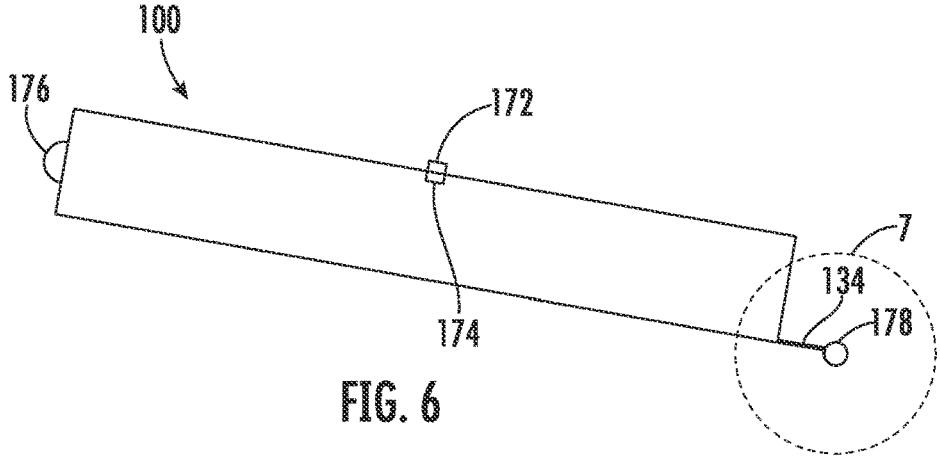
FIG. 6 is a schematic perspective view of the structure of FIG. 1 in a collapsed state.
Figure 7:
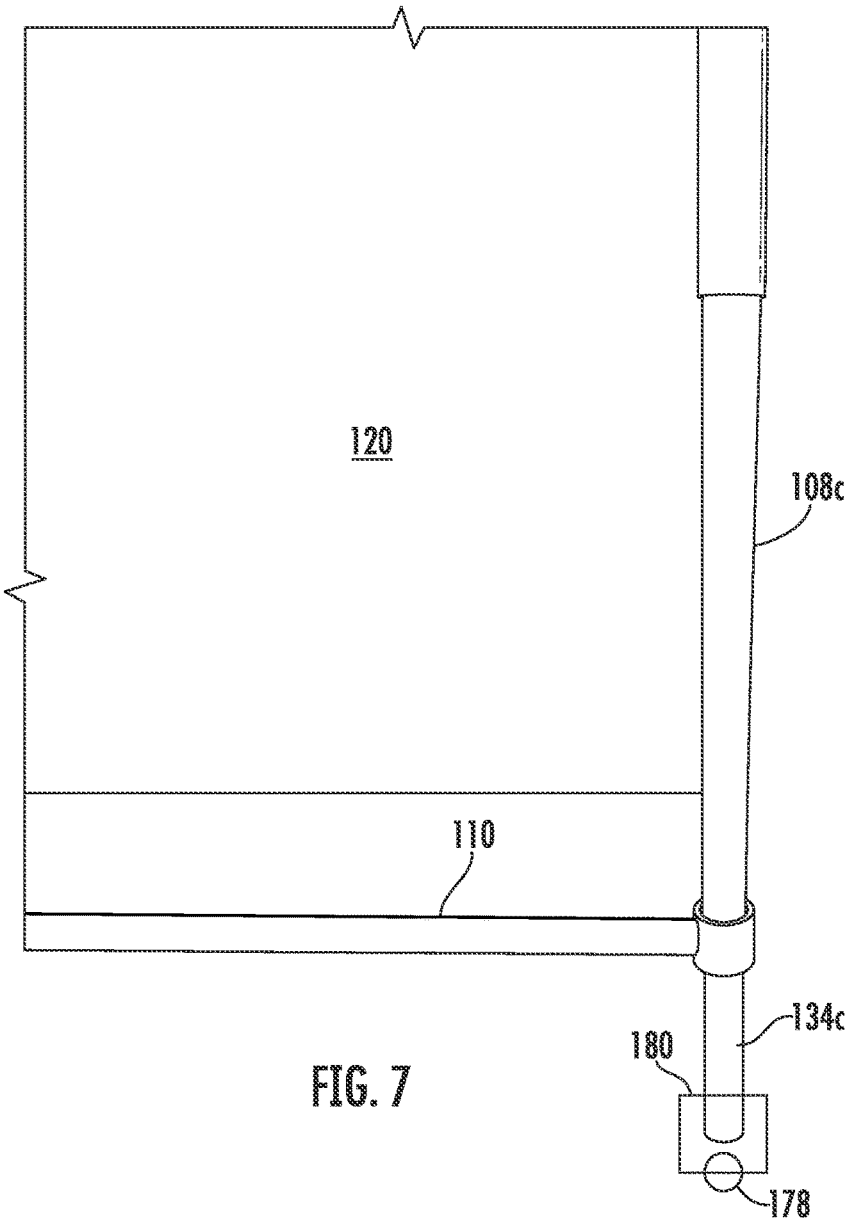
FIG. 7 is an enlarged schematic view of the vertical supports of FIG. 1, showing the attachment of a wheel.

To collapse the toilet 100 to the position shown in FIG. 6, each horizontal support 110, including the main cross bar 112, can collapse along a horizontal axis A1, and each vertical support 108 is configured to collapse along a longitudinal axis A2. After collapse, the toilet 100 can then be folded upon itself, for example similar to a palletized container. A fastener 172 can be included on one wall 118, 120, 122, 124, 126 and a mating fastener 174 can be included on any other suitable wall to retain the toilet 100 in the collapsed state. In certain embodiments, fasteners 172, 174 can be ties configured to wrap around an exterior of the collapsed toilet 100. In certain embodiments, the fastener 172 can be included on a strap configured to wrap around the collapsed toilet and mate with fastener 174. Any other suitable fastening mechanism is contemplated herein.

A handle portion 176 (e.g. a handle as shown, or an arm strap) can be disposed on a respective horizontal support 110 for ease of carrying. In certain embodiments, at least one wheel 178 can be disposed on at least one of a respective vertical supports 108 opposite the handle portion 176, so that the toilet 100 may be dragged behind the user without having to lift its entire weight. Shown in FIG. 7, the at least one wheel 178 can be hingedly connected to the lower anchor portion 134 of the respective vertical support 108 in a manner that allows use of the wheel 178 when the toilet 100 is being dragged, but prevents the wheel 178 from hindering use of the lower anchor portions 134 when staking the toilet 100. For example, the wheel 178 can be attached to the lower anchor portion 134 using a pin 180 disposed through the lower anchor portion 134, such that when erecting the structure 100, the wheel can rotate about the pin 180, allowing the lower anchor portion 134 to be inserted into the ground 136.

Figure 8:
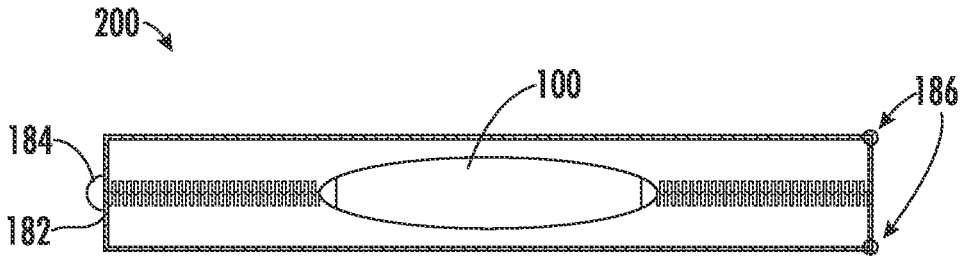
FIG. 8 is a schematic perspective view of a personal, portable toilet kit.

As shown in FIG. 8, in certain embodiments, the personal, mobile, toilet can be a kit 200 comprising the toilet 100 as described above, and a container 182 sized to retain the personal, mobile, toilet 100 in the collapsed state. It is also contemplated that the container 182 can similarly include a handle portion 184 and wheels 186, similar to the structure itself. It should be appreciated by those having ordinary skill in the art, the toilet as described herein can be used for any other suitable purpose in which privacy is needed in a space where it cannot be otherwise provided. For example, the toilet can be erected and used as a changing room, a diaper changing area, a nursing room or the like. Therefore, the invention as described can be used as any suitable portable privacy device.

The methods and systems of the present disclosure, as described above and shown in the drawings, provide for privacy in public spaces, or in areas where privacy is not easily found, whether for use as a toilet or other privacy device. For example, certain embodiments can provide useful for the following scenarios including, but not limited to, children who may need instant access to a toilet, and/or adults experiencing certain conditions that may require urgent need for immediate access to a toilet. Further, the system is designed for ease of operation so that any user can quickly erect and make use of the system with minimal effort, especially users that may have limited physical capabilities. While the apparatus and methods of the subject disclosure have been shown and described, those skilled in the art will readily appreciate that changes and/or modifications may be made thereto without departing from the scope of the subject disclosure.

What is claimed is:

1. An apparatus comprising:

a frame, the frame including:

a plurality of telescoping vertical supports; and a plurality of telescoping horizontal supports hingedly connected to a respective vertical support of the plurality of vertical supports; and a telescoping main cross bar hingedly connected to and extending between at least two of the vertical supports situated in a diameter depression in the at least two of the vertical supports;

a seat hingedly connected to the main cross bar; and an outer shell operatively connected to a respective portion of the frame defining a plurality of walls.

2. The apparatus of claim 1, wherein the outer shell defines a front wall, a back wall opposite the front wall, a first side wall, a second side wall opposite the first side wall, and a top wall.

3. The apparatus of claim 2, wherein the front wall is hingedly connected to a single vertical support on a first end and further comprising a fastener on a second end opposite the first end, configured to mate with a respective fastener on the second side wall in a closed position.

4. The apparatus of claim 3, wherein the first side wall and second side wall are each hingedly connected to a first and second respective vertical support of the plurality of vertical supports.

5. The apparatus of claim 4, further comprising a top wall hingedly connected to a respective horizontal support a first end, wherein the top wall further includes a fastener on a second end opposite the first end, configured to mate with a respective fastener on the front wall in a closed position and to retain the top wall and the front wall in respective closed positions.

6. The apparatus of claim 4, wherein the front wall, back wall, first side wall, and second side wall are positioned such that the apparatus occupies a rectangular footprint in an erected state.

7. The apparatus of claim 1, further comprising an extension arm hingedly connected to and extending horizontally from a respective one of the vertical supports.

8. The apparatus of claim 7, wherein the extension arm further includes a stopper on a free end of the extension arm, opposite the hinged connection.

9. The apparatus of claim 7, where the respective one of the vertical supports has a first diameter and a second diameter, the first diameter being larger than the second diameter, wherein the extension arm is hingedly connected to the respective one of the vertical supports on the second diameter to allow rotational movement of the extension arm about the respective one of the vertical supports and to prevent vertical movement of the extension arm along the respective one of the vertical supports.

10. The apparatus of claim 1, wherein the seat further includes an upper rim and a lower rim separate from the upper rim, the upper rim and lower rim hingedly connected to the main cross bar and configured to clamp a waste collection device therebetween.

11. The apparatus of claim 10, wherein the seat further comprises at least one weight bearing member hingedly connected to an underside of the lower rim, configured to support a user seated on the seat.

12. The apparatus of claim 10, wherein the main cross bar further includes at least one stopper proximate the seat configured to limit an amount of collapse of the main cross bar.

13. The apparatus of claim 1, wherein each of the plurality of vertical supports include a lower anchor portion configured to anchor the apparatus when erected, wherein each of the lower anchor portions extend beyond an lower edge of an outer perimeter of a respective front, side, or back wall.

14. The apparatus of claim 1, wherein each horizontal support is configured to collapse along a horizontal axis and wherein each vertical support is configured to collapse along a longitudinal axis, and wherein the apparatus is configured to fold upon itself in a collapsed state.

15. The apparatus of claim 14, wherein at least one wall furthers include a fastener and at least one wall includes respective mating fastener configured to retain the apparatus in the collapsed state.

16. The apparatus of claim 14, further comprising a handle portion disposed on a respective horizontal support.

17. The apparatus of claim 16, further comprising at least one wheel disposed on at least one of a respective vertical support opposite the handle portion, wherein the at least one wheel is hingedly connected to the respective vertical support.

18. The apparatus of claim 1, wherein the outer shell is opaque, and wherein the outer shell is comprised of at least one of burlap, mesh, and/or canvas.

19. A personal, mobile, toilet kit comprising:

a toilet seat hingedly connected to a frame having a plurality of horizontal and vertical supports, wherein the plurality of horizontal supports are hingedly connected to a respective vertical support of the plurality of vertical supports, wherein a telescoping main cross bar is hingedly connected to and configured to extend between at least two of the vertical supports situated in a diameter depression in the at least two of the vertical supports, wherein the toilet seat is hingedly connected to the main cross bar;

an outer shell operatively connected to the frame, configured to define a plurality of walls in an erected state; and a container configured to retain the personal, mobile, toilet in a collapsed state.

20. The kit of claim 19, wherein the collapsed state includes each horizontal support collapsed along a horizontal axis, each vertical support is collapsed along a longitudinal axis, and the frame and outer shell folded upon itself.

* * * * *